US006883994B1

(12) United States Patent
Grogg

(10) Patent No.: US 6,883,994 B1
(45) Date of Patent: Apr. 26, 2005

(54) CLEANING DEVICE WITH BEAD HOLDER

(76) Inventor: Sheryl Grogg, 4 Cricket La., Dobbs Ferry, NY (US) 10522

( * ) Notice: Subject to any disclaimer, the term of this patent is extended or adjusted under 35 U.S.C. 154(b) by 11 days.

(21) Appl. No.: 10/643,051

(22) Filed: Aug. 18, 2003

Related U.S. Application Data

(63) Continuation of application No. 09/686,579, filed on Oct. 11, 2000, now abandoned.

(51) Int. Cl.[7] ..... A47K 7/02
(52) U.S. Cl. ..... 401/201; 401/207; 401/196
(58) Field of Search ..... 401/201, 196, 401/207, 200

(56) References Cited

U.S. PATENT DOCUMENTS 5,857,794 A * 1/1999 Chien ..... 401/201
6,015,242 A * 1/2000 Gillis ..... 401/201
6,042,288 A * 3/2000 Rattinger et al. ..... 401/201
6,048,407 A * 4/2000 Schoch ..... 134/6
6,210,062 B1 * 4/2001 Kokubo ..... 401/201

* cited by examiner

*Primary Examiner*—David J. Walczak
(74) *Attorney, Agent, or Firm*—Milbank, Tweed, Hadley & McCloy, LLP

(57) ABSTRACT

A cleansing device comprising a mesh body, a cavity attached to the mesh body, the cavity comprising a pouch for holding a personal care product in the cavity such that the personal care product is transferred to at least a portion of the mesh body when the cleansing device is used. The personal care product is one or more beads filled with soap or lotion. The cleansing device may comprise a second cavity attached to the mesh body, the second cavity comprising a second pouch for holding a personal care product in the cavity such that the personal care product is transferred to at least a portion of the mesh body when the cleansing device is used. The pouch preferably has an elastic opening such that the person care product may be replaced when it has been used up.

5 Claims, 3 Drawing Sheets

CLEANING DEVICE WITH BEAD HOLDER

This application is a continuation of application Ser. No. 09/686,579, filed Oct. 11, 2000, now abandoned.

FIELD OF INVENTION

This invention relates to bathing and cleansing articles, such as, for example, a personal hygiene device in the form of a handheld bath poufs.

BACKGROUND OF THE INVENTION

The idea of using a handheld ball-like bath pouf to assist in personal hygiene is well known in the industry. Such poufs have several beneficial properties over other personal cleansing tools such as sponges and washcloths. One such property is that they increase lather, even when using less-expensive artificial soaps. Sufficient lather is not only necessary for proper cleansing functionality, but can make for a more pleasant bathing experience.

The shape of poufs make them easy to hold, and the netting, typically a diamond mesh polymeric, provides a soothing massage. Further, they tend to hold water less than a sponge does after a shower. This is advantageous since such water can lead to mildew formation.

Poufs can be easily manufactured in a wide variety of colors by changing the color of the polymer used in the mesh. This variety of colors, combined with the pleasing shape, can make them a more attractive addition to bathroom decor than a sponge or washcloth.

SUMMARY OF THE INVENTION

In one aspect, the invention features a bath pouf cleansing device comprising a mesh body, a cavity attached to said mesh body, the cavity comprising means for holding a personal care product in the cavity such that the personal care product is transferred to at least a portion of the mesh body when the pouf is used.

In preferred embodiments, the personal care product is one or more beads filled with soap or lotion.

The bath pouf may comprise a second cavity attached to the mesh body, the second cavity comprising means for holding a personal care product in the cavity such that the personal care product is transferred to at least a portion of the mesh body when the pouf is used.

The means for holding the personal care product may include a mesh pouch having an elastic opening.

DETAILED DESCRIPTION OF THE PREFERRED EMBODIMENTS

Figure 1:
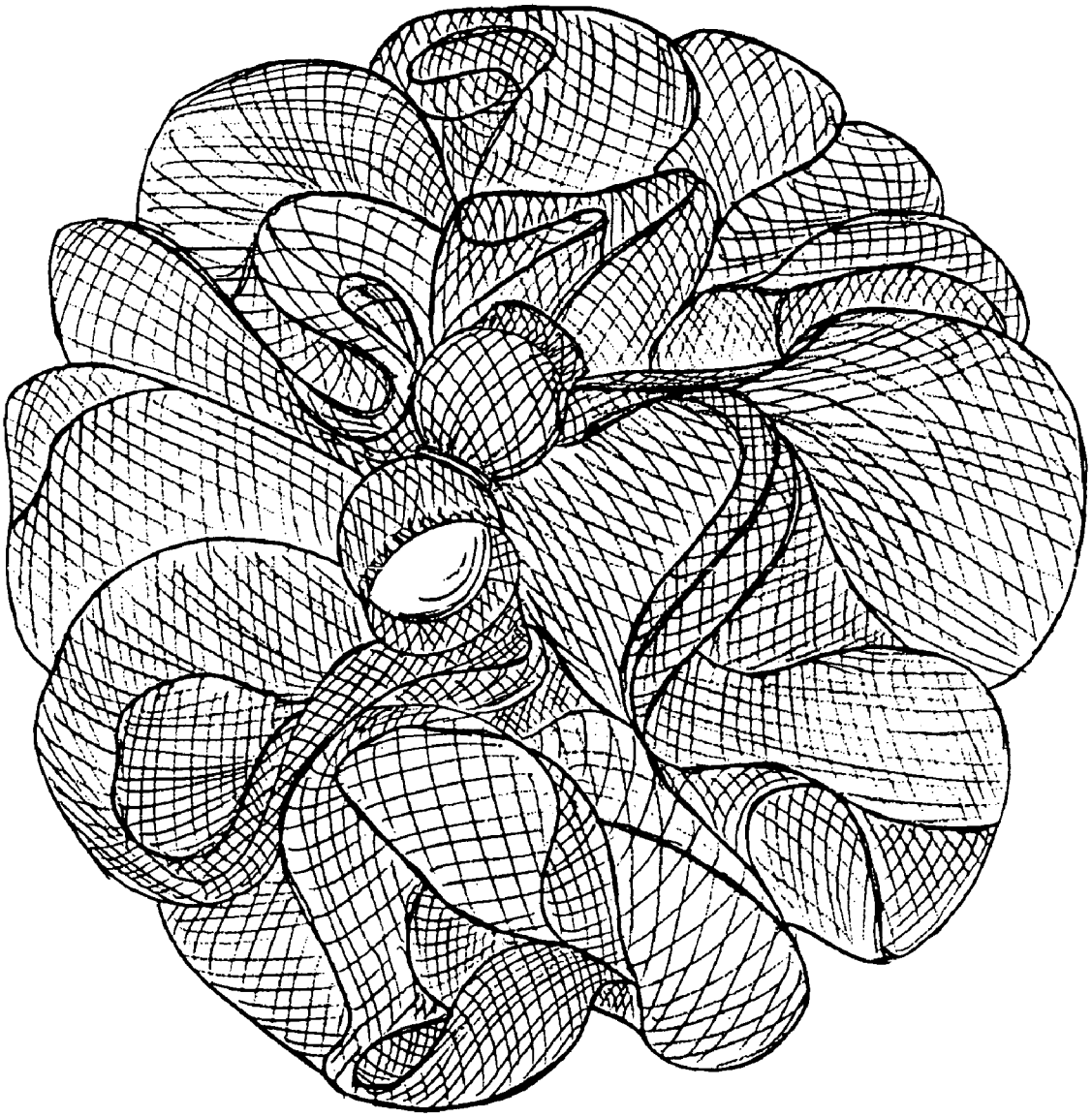
FIG. 1 shows a perspective view of a personal hygiene device in accordance with a first embodiment of the invention.

Referring to FIG. 1, a first embodiment of the invention includes a plurality of plys of extruded tubular netting mesh

10 folded upon themselves numerous times to form a ball-like shape, said shape being maintained by a fastener 12. This fastener is preferably an elastic closure. However, in other embodiments, fastener 12 may be a rope, plastic, wood, or metal fastener or some other fastener that would serve the stated function.

A sewn netted tube 14 is held against the pouf 10 by fastener 12. The dimensions of tube 14 are such that it may hold two soap beads 16, situated in the manner shown in the drawing. The tube should be formed so as to allow easy insertion of the beads, while preventing the beads from falling out once they are placed inside.

One method of properly securing the beads into the pouf is to incorporate fibers with elastic properties into the sewn netted tube. The tube would then possess the property that said beads, once inserted, would stay in the tube due to the force exerted by the elastic fibers. Such elastic fibers are well known to those of skill in the art.

As can be seen in FIG. 1, the elastic openings of the tubes 14 will, when the beads are inserted, assume a size sufficiently smaller than the beads so as to retain the beads in tubes 14. When the user desires to replace the beads, the elastic properties of the tubes 14 will allow the openings of the tubes to be stretched to larger sizes thereby permitting removal and replacement of the beads. The elastic will allow repeated opening and closing of the tube openings.

Beads 16 are well known in the industry and are generally comprised of an outer gel coating that envelopes a manufacturer-determined amount of product. The gel coating remains intact under storage conditions, but dissolves under bathing conditions such as heat or moisture, such dissolution leading to release of the product.

Such beads offer many benefits. For example, they come in pleasing colors, scents and shapes which can easily match most bathroom decors and user tastes. Another advantage is that the beads contain a manufacturer-determined amount of product.

Although fastener 12 is shown serving the dual purpose of maintaining the ball-like shape of the pouf 10 and holding the netted tube 14 against the pouf 10, it should be noted that separate fasteners may be used for each purpose.

Figure 2:
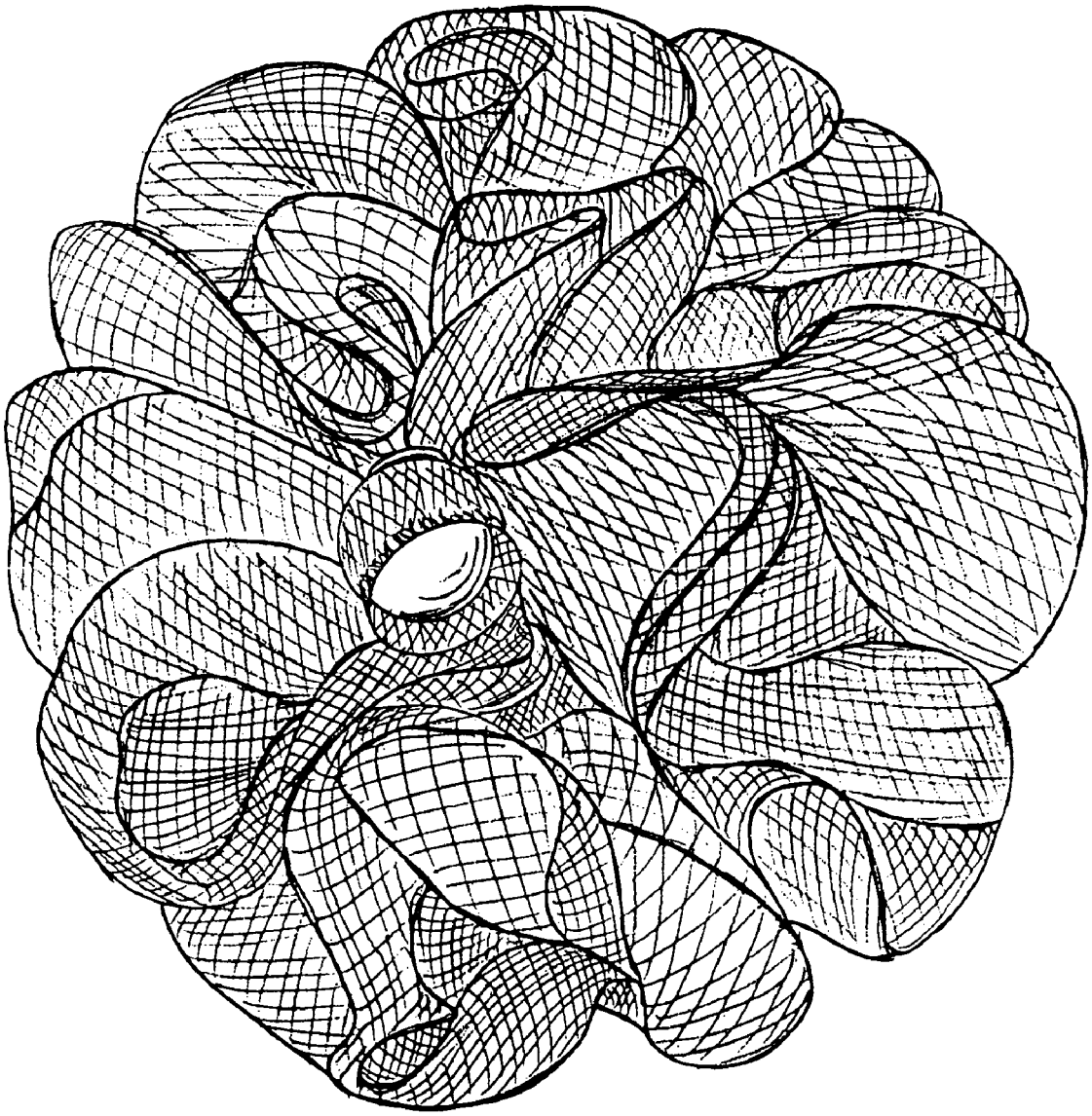
FIG. 2 shows a perspective view of a personal hygiene device in accordance with a second embodiment of the invention.

Referring to FIG. 2, a second embodiment of the invention differs from the fist embodiment in that the netted tube 24 is designed to hold a single bath bead 16.

Figure 3:
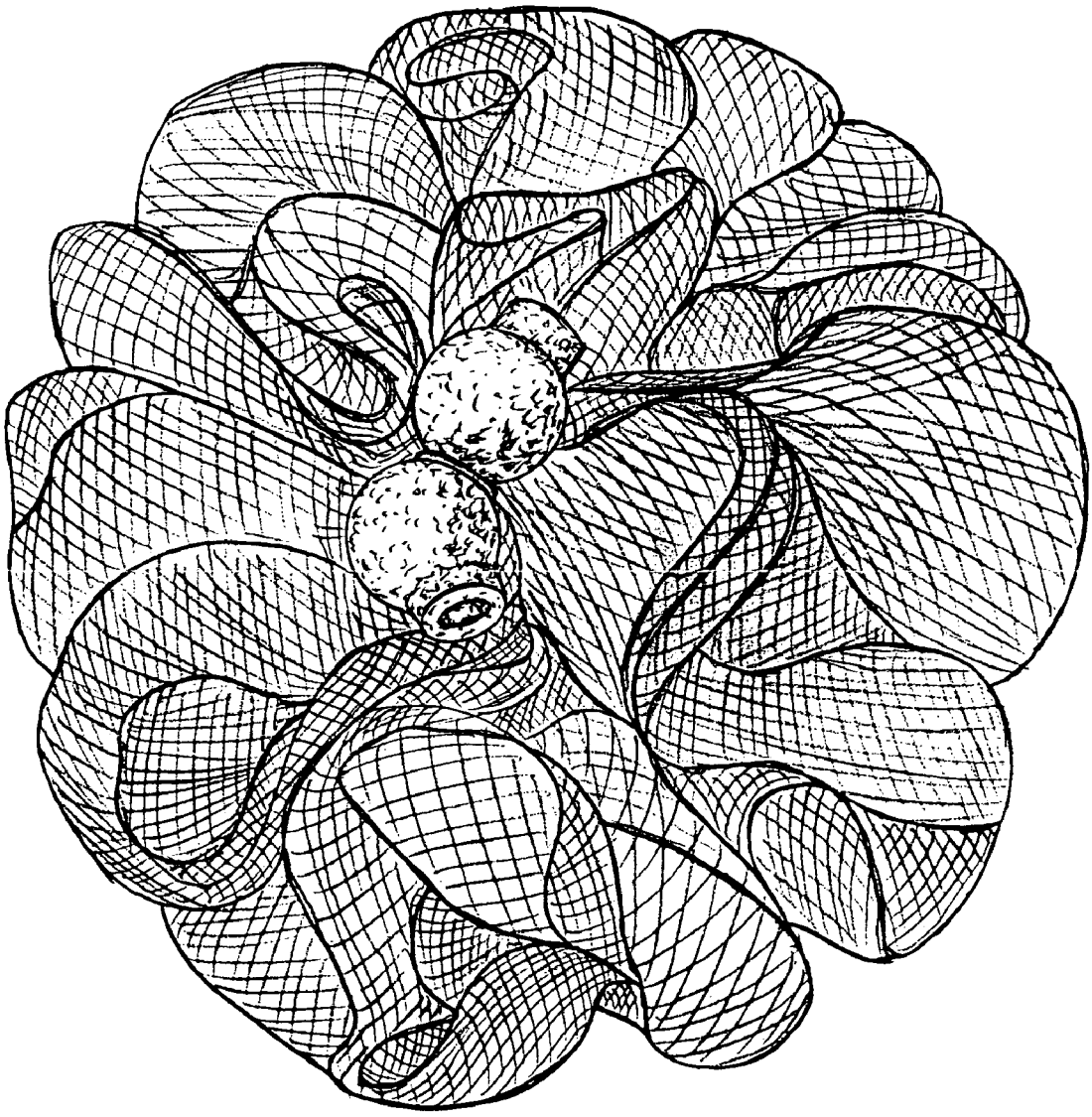
FIG. 3 shows a perspective view of a personal hygiene device in accordance with a third embodiment of the invention.

Referring to FIG. 3, a third embodiment differs from the embodiment in FIG. 1 in that a tube 34 is used to secure the beads, with tube 34 being made from a sponge material. Tube 34 should have properties similar to tube 14. One such property is the ability to allow easy insertion of the beads, while preventing said beads from falling out once they are placed inside. Various approaches for achieving this should be obvious to one in the skill of the art. For example, one may use a synthetic sponge material with inherent elastic properties.

From the description above, a number of advantages of the present invention become evident. For example, it is unnecessary to manually transfer soap, moisturizer, or the like from their respective bars or containers to the pouf. The present invention uses beads, each of which automatically dispenses its respective product onto the pouf. The gel coating of the bead dissolves under bathing conditions such as heat or moisture, such dissolution leading to release of the product. Because of the proximity of the bead-holding tube to the pouf, the released product is easily transferred to the pouf. The beads can loaded into the pouf's tube before entering the shower, thereby avoiding any slippery conditions that might make loading the beads difficult.

The present invention also allows soap beads to be used for general bathing, whereas such beads are otherwise only typically useful as drop-in additives to tub water. This means that the benefits of bath beads can be enjoyed for a wider variety bathing tasks than is currently feasible. Furthermore, because the bath beads automatically release the amount of product predetermined by the manufacturer, the user gets the proper dose and wastage of product is prevented since the user does not have the opportunity to spill product on the floor or transfer an unnecessarily large amount of product to the pouf.

The embodiments of FIGS. 1 and 3 offer the additional advantage of allowing the user to make his or her own mixture of soap, lotion, etc. by choosing two beads with different properties. For example, the user may insert a first bead filled with soap, and a second bead filled with conditioner. Alternately, the user may choose two soaps with different fragrances so as to create a personal scent pleasing to the user.

The two-bead embodiment may also prove useful for circumstances in which a two halves of a conditioner, medication, or the like need to be mixed at time of use. For example the first bead may contain an inactive form of a product, while the second bead may contain an activator for that first product, such that the contents of the two beads mix to form a final product.

This could be useful in a case where the final product is such that it looses its effectiveness a short time after being created, and thus must be mixed at the time of use. The two-bead embodiment can make such a product much easier to use, possibly freeing the user from having to measure and mix two components of a product using measuring tubes or the like.

The hygiene device has a netted, poufed, ball-like configuration which allows it to fit easily into the hand and makes it easy to grip. Further, this configuration makes the device visually attractive, physically satisfying to use, and provides for effective cleansing. For example the netting is mildly abrasive to the skin, a property which both increases cleansing effectiveness and leads to a pleasant physical sensation.

The tubes may hold a wide variety of shapes of soap bead. For example, the tubes may hold not only beads with spherical shapes, but also beads with geometric shapes, animal shapes, etc.

The hygiene device of the present invention is also compatible with bath beads which must be squeezed in order to release their product. When loaded with beads of this sort, the user must squeeze the tube component in order for the product to be released onto the pouf component.

It should be obvious to one skilled in the art that most if not all varieties of bath beads will be compatible with this hygiene device.

The manufacturer may choose to insert the bead or beads in the tube component at the time of manufacture. Such an embodiment would provide further ease of use for the user, as he or she would not have to load the tube the first time it is used.

The present invention can be manufactured by externally attaching the tube component to a standard polymeric mesh bath pouf.

Thus, with a simple modification of manufacturing method, the new invention can easily be produced by a manufacturing plant for poufs of the prior art. Since typical poufs of the prior art already have a rope, elastic band, or the like maintaining the shape of the pouf, the modification to the manufacturing method need only involve fastening the tube to the pouf via this fastener.

Although the description above contains many details, it should be recognized that these details were employed for the purposes of illustrating the preferred embodiments of the invention. Thus these details should not be taken to limit the scope of the invention.

For example, in another embodiment, the pouf could be made of strips of foam configured so as to form a sphere-like shape. In another embodiment, the pouf component may be replaced with a sponge or washcloth.

Also note that the shape of the pouf component is not limited to the described spherical shape. The component can conceivably take other shapes that are esthetically pleasing, such as cones, cubes, and egg-like shapes.

Further, while this disclosure has concentrated on personal hygiene, when loaded with appropriate beads the hygiene device of the present invention becomes a general purpose cleansing device suitable for household, kitchen, car, industrial, and similar cleaning jobs. Such appropriate beads would include beads filled with polishing compound, household cleanser and industrial cleanser. Such a bead could generically be called "encased cleansing product". Like the disclosed personal hygiene device, these encased cleansing products could either be loaded in the tubes by the user, or placed there at time of manufacture.

For such a general purpose cleansing device, the disclosed personal cleansing tool component (e.g., a pouf) would ideally be replaced with a general cleansing tool designed for general cleansing. Examples of such general cleansing tools are scouring pads, as well as washcloths, sponges, and poufs constructed to endure the stresses of household or industrial cleansing tasks. The invention is also ideal for cleaning or applying lotions to pets.

Note also, that similar and related embodiments obvious to one skilled in the art should be considered to be within the scope of this invention.

Thus the scope of the invention should be determined by the appended claims and their legal equivalents, rather than by the examples given.

What is claimed is:

1. A cleansing device comprising:

a mesh body;

a separately formed cavity attached to said mesh body, said cavity comprising an opening that can be adjusted between first and second sizes, wherein said first size allows the passage of a personal care product into said cavity such that said personal care product is transferred to at least a portion of said mesh body when said cleansing device is used, wherein said second size prohibits the passage of said personal care product through said opening to thereby retain said personal care product in said cavity; and wherein said opening may be repeatedly increased and decreased between said first and second sizes to allow the replacement of said personal care product.

2. The cleansing device of claim 1 wherein said personal care product is one or more beads filled with soap.

3. The cleansing device of claim 1 wherein said personal care product is one or more beads filled with lotion.

4. A cleaning device comprising a mesh body:

a cavity attached to said mesh body, said cavity comprising an opening that can be adjusted between first and second sizes; and a second cavity attached to said mesh body, said second cavity comprising an opening that can be adjusted between third and fourth sizes, wherein said first and third sizes allow the passage of personal care products into said respective cavities such that personal care products are transferred to at least portion of said mesh body when said cleansing device is used, wherein said second and fourth sizes prohibit the passage of said personal care products through said openings to thereby retain said personal care products in said cavities; and wherein said openings may be repeatedly increased and decreased to allow the replacement of said personal care products.

5. The cleansing device of claim 1 wherein said opening comprises an elastic band that allows the size of said opening to be repeatedly increased and decreased.

* * * * *

UNITED STATES PATENT AND TRADEMARK OFFICE

CERTIFICATE OF CORRECTION

PATENT NO. : 6,883,994 B1
APPLICATION NO. : 10/643051
DATED : April 26, 1994
INVENTOR(S) : Sheryl Grogg It is certified that error appears in the above-identified patent and that said Letters Patent is hereby corrected as shown below:

ON THE COVER PAGE:

Item (22) "Aug. 18, 2003" should be deleted and --August 15, 2003 -- inserted therefor.

Signed and Sealed this

Fifth Day of June, 2007

JON W. DUDAS
*Director of the United States Patent and Trademark Office*

UNITED STATES PATENT AND TRADEMARK OFFICE

CERTIFICATE OF CORRECTION

PATENT NO. : 6,883,994 B1
APPLICATION NO. : 10/643051
DATED : April 26, 2005
INVENTOR(S) : Sheryl Grogg It is certified that error appears in the above-identified patent and that said Letters Patent is hereby corrected as shown below:

ON THE COVER PAGE:

Item (22) "Aug. 18, 2003" should be deleted and --August 15, 2003 -- inserted therefor.

This certificate supersedes Certificate of Correction issued June 5, 2007.

Signed and Sealed this

Third Day of July, 2007

JON W. DUDAS
*Director of the United States Patent and Trademark Office*